US009878878B2

(12) United States Patent
Saarelainen et al.

(10) Patent No.: US 9,878,878 B2
(45) Date of Patent: Jan. 30, 2018

(54) ELEVATOR

(71) Applicants: Antti Saarelainen, Espoo (FI); Kimmo Koivisto, Hollola (FI); Riku Lampinen, Helsinki (FI)

(72) Inventors: Antti Saarelainen, Espoo (FI); Kimmo Koivisto, Hollola (FI); Riku Lampinen, Helsinki (FI)

(73) Assignee: Kone Corporation, Helsinki (FI)

( * ) Notice: Subject to any disclaimer, the term of this patent is extended or adjusted under 35 U.S.C. 154(b) by 1 day.

(21) Appl. No.: 14/823,249

(22) Filed: Aug. 11, 2015

(65) Prior Publication Data

US 2016/0046463 A1 Feb. 18, 2016

(30) Foreign Application Priority Data

Aug. 18, 2014 (EP) ..... 14181259

(51) Int. Cl.

| | |
|---|---|
| ***B66B 7/12*** | (2006.01) |
| ***B66B 5/02*** | (2006.01) |
| *B66B 7/06* | (2006.01) |

(52) U.S. Cl.

CPC ..... *B66B 7/1215* (2013.01); *B66B 5/02* (2013.01); *B66B 7/062* (2013.01)

(58) Field of Classification Search

CPC ..... B66B 7/1215; B66B 7/062; B66B 5/02

USPC ..... 187/391

See application file for complete search history.

(56) References Cited

U.S. PATENT DOCUMENTS 3,208,729 A * 9/1965 Townsen ..... B66D 3/24 200/61.15
4,145,920 A * 3/1979 Yamagami ..... B66B 7/1223 187/266
4,213,019 A * 7/1980 Houp ..... E05D 13/00 200/47

(Continued)

FOREIGN PATENT DOCUMENTS

EP 14168760 * 5/2014
WO WO 2014001371 A1 * 1/2014 ..... B66B 5/0031

*Primary Examiner* — Michael A Riegelman
(74) *Attorney, Agent, or Firm* — Harness, Dickey & Pierce, P.L.C.

(57) ABSTRACT

An elevator comprising an elevator car;

a plurality of belt-shaped ropes connected to the car, each having a width larger than thickness as measured in transverse direction of the rope; and at least one rope wheel, around which the belt-shaped ropes pass;

wherein the rope wheel comprises a plurality of circumferential rope contact areas distributed in axial direction thereof, one of said ropes passing against each circumferential rope contact area, the elevator further comprising a sensing arrangement for sensing displacement of one or more of said ropes, comprising a sensing member for sensing displacement of one or more of said ropes radially outwards from the rope wheel, extending in axial direction of the rope wheel along its surface at a radial distance therefrom, whereby a gap is formed between the sensing member and each rope contact area, the height of the gap being more than thickness of the belt-shaped ropes and less than 2.2 times the thickness of the belt-shaped ropes;

sensing member being displaceable by a rope colliding into contact with it, and the sensing arrangement is (Continued)

arranged to trigger one or more predefined action in response to displacement of the sensing member.

19 Claims, 4 Drawing Sheets

(56) References Cited

U.S. PATENT DOCUMENTS

| | | | | |
|---|---|---|---|---|
| 5,886,308 | A * | 3/1999 | Ericson | B66B 7/10 187/391 |
| 6,364,062 | B1 * | 4/2002 | Ericson | B66B 7/062 187/264 |
| 7,309,059 | B2 * | 12/2007 | Marcil | B66D 1/56 254/271 |
| 2004/0256180 | A1 * | 12/2004 | Eichhorn | B66B 15/04 187/254 |
| 2008/0223665 | A1 * | 9/2008 | O'Donnell | B66B 7/062 187/256 |
| 2011/0315489 | A1 * | 12/2011 | Nakamori | B66B 7/1215 187/391 |
| 2012/0024637 | A1 * | 2/2012 | Henneau | B66B 5/125 187/394 |
| 2014/0305744 | A1 * | 10/2014 | Kere | B66B 7/1238 187/254 |
| 2015/0158697 | A1 * | 6/2015 | Zapf | B66B 15/02 187/266 |
| 2015/0329319 | A1 * | 11/2015 | Lehtinen | B66B 7/1215 187/254 |

* cited by examiner

ELEVATOR

FIELD OF THE INVENTION

The invention relates to an elevator for transporting passengers and/or goods.

This application claims priority to European Patent Application No. EP14181259 filed on Aug. 18, 2014, the entire contents of which are incorporated herein by reference.

BACKGROUND OF THE INVENTION

An elevator typically comprises an elevator car and a counterweight, which are vertically movable in a hoistway. These movable elevator units are interconnected to each other by a suspension roping that suspends them on opposite sides of rope wheels mounted above the movable elevator units. For providing force for moving the suspension roping, and thereby also for the elevator units, one of the wheels is typically a drive wheel engaging the suspension roping, which drive wheel is rotated by motor. The motor is typically automatically controlled by an elevator control system.

In elevators, the roping comprises at least one but typically several ropes passing alongside each other. There are elevators where the ropes are belt-shaped, i.e. they have a cross section with width substantially greater than the thickness thereof. Position of the belt-shaped ropes relative to each rope wheel around which they pass (in the axial direction of the wheel) as well as relative to other ropes needs to be controlled so that adjacent ropes do not drift too close to each other, and so that none of the ropes drifts in said axial direction away from the circumferential rope contact area of the wheel against which the rope in question is intended to rest. One way to control this axial position of the belt-shaped ropes is to shape the circumferential rope contact areas of the wheel cambered. Each cambered circumferential rope contact area has a convex shape against the peak of which the rope rests. The cambered shape tends to keep the rope passing around it positioned resting against the peak thereof, thereby resisting displacement of the rope away from the point of the peak.

In prior art, a drawback has been that there has not been a simple and efficient way to monitor the position of ropes. Particularly, this has been difficult in case where the rope wheel is a cambered rope wheel.

BRIEF DESCRIPTION OF THE INVENTION

The object of the invention is, inter alia, to alleviate previously described drawbacks of known elevators and problems discussed later in the description of the invention. The object of the invention is to introduce an elevator where undesired position of one or more ropes passing around a rope wheel can be sensed and reacted to in a simple and efficient manner. An object is particularly to introduce a solution advantageously usable in elevators wherein position of ropes is controlled by cambered shape of the rope wheel.

Advantageous embodiments are presented, inter alia, which can be configured to allow each rope to slightly wander and seek its position on a circumferential rope contact area of the rope wheel without triggering any safety measures. Advantageous embodiments are presented, inter alia, where rope position can be sensed with mechanical sensing member(s) without causing damage to the ropes by the sensing member(s) in any situation. Further advantages achievable by implementing the invention are that the rope sensing can be formed compact and maintenance friendly.

It is brought forward a new elevator comprising an elevator car; a plurality of belt-shaped ropes connected to the car, each having a width substantially larger than thickness as measured in transverse direction of the rope, and at least one rope wheel, around which the belt-shaped ropes pass. The rope wheel comprises a plurality of circumferential rope contact areas distributed in axial direction thereof, one of said ropes passing against each circumferential rope contact area. The elevator further comprises a sensing arrangement for sensing displacement of one or more of said ropes, comprising a sensing member for sensing displacement of one or more of said ropes radially outwards from the rope wheel, extending in axial direction of the rope wheel along its surface at a radial distance therefrom, whereby a gap is formed between the sensing member and each rope contact area, the height of the gap being more than thickness of the belt-shaped ropes and less than 2.2 times the thickness of the belt-shaped ropes. Thus, the sensing member is necessarily very close to the back surface of the ropes passing between the sensing member and the circumferential rope contact areas. In case any of the ropes happen to wander in axial direction of the rope wheel away from its intended position, i.e. away from its circumferential rope contact area such that it crosses any of the other ropes, a contact between the topmost of the crossing ropes and the sensing member will likely take place. On the other hand the height h of the gap g being more than thickness t of the belt-shaped ropes facilitates that no such contact takes place during normal situations where there is only said one rope resting firmly against each circumferential rope contact area. With this configuration rope crossing situations can be sensed in a simple and efficient manner. The sensing member is displaceable, in particular by a rope colliding into contact with it, and the sensing arrangement is arranged to trigger one or more predefined action in response to displacement of the sensing member. Thus, elevator can be arranged to react appropriately to the displacement of ropes. Preferably, the height of the gap is equal or less than 2 times the thickness of the belt-shaped ropes. Thus, it can be ensured that said contact occurs in any possible kind of crossing of two of the ropes. Preferably, the height of the gap is more than 1.5 times the thickness of the belt-shaped ropes. Thus, unnecessary contacts between the rope and the sensing member can be reliably avoided. Most preferably, the height of the gap is more than 1.5 times the thickness of the belt-shaped ropes and equal or less than 2 times the thickness of the belt-shaped ropes, whereby the gap is of optimal height in terms of ensuring that said contact occurs when two ropes have crossed, and only then.

In a preferred embodiment, the sensing arrangement further comprises a second sensing member for sensing displacement of one or more of said ropes axially (i.e. in axial direction of the rope wheel) outwards from the rope wheel on axially (i.e. in axial direction of the rope wheel) outer side of each axially outermost rope, which second sensing member is displaceable by a rope colliding into contact with it, and the sensing arrangement is arranged to trigger said one or more predefined action in response to displacement of the second sensing member. Preferably, each said second sensing member is fixedly connected to aforementioned sensing member for sensing displacement of one or more of said ropes radially outwards from the rope wheel. Thereby they are displaceable together as one structure by a rope colliding into contact with any one of them. The sensing arrangement is then arranged to trigger said one or more predefined action in response to displacement of the structure formed by said sensing members.

In a preferred embodiment, each of said circumferential rope contact areas is cambered. In this kind of solution, the defined rope position sensing is particularly preferable. With the defined arrangement for rope position sensing the elevator can be configured to allow each rope to slightly wander axially and seek its position on a cambered circumferential rope contact area of the rope wheel without triggering any safety measures. In this embodiment, particularly, each said rope contact area is cambered and has a convex shape having a peak against which one of said ropes passes. The surface of each circumferential has an arc shape. Preferably, between immediately adjacent rope contact areas, there is a depression.

In a preferred embodiment, the spaces between immediately adjacent ropes passing against a circumferential rope contact area are completely devoid of components of the sensing member (or any component attached thereto. This is advantageous, because this makes it possible that each rope can wander freely to seek its position on the cambered area without triggering any safety measures. This kind of position seeking can happen because of building sway, loading or unloading of machinery room floor, for instance. For this end, it is preferable that said sensing member does not have protrusions extending therefrom towards the drive wheel into spaces between immediately adjacent ropes passing against a circumferential rope contact area.

In a preferred embodiment, sensing member is elongated. Preferably, the elongated sensing member comprises an elongated and at least substantially straight side face facing the drive wheel and extending over all the rope contact areas. Thus, the sensing member is simple to configure not to have protrusions extending therefrom towards the drive wheel into spaces between immediately adjacent ropes.

In a preferred embodiment, said one or more predefined action includes stopping rotation of the drive wheel of the elevator. Thus, the faulty situation can be reacted to swiftly and efficiently in terms of safety and simplicity. Said stopping rotation of the drive wheel preferably includes braking rotation of the drive wheel with mechanical brake(s) such as brake(s) acting on the drive wheel or a component fixed thereto of the elevator and/or stopping the motor from rotating the drive wheel. This is preferably implemented such that said triggering includes breaking of the safety circuit of the elevator breaking of which is arranged to cause activation of mechanical brake(s) of the elevator and/or stopping of the motor from rotating the drive wheel.

In a preferred embodiment, said sensing member is displaceable at least in the longitudinal direction of the rope, and the rope, when it moves in its longitudinal direction during elevator use and is displaced in said radial direction to collide into contact with the sensing member is arranged to engage the sensing member and push and displace it at least in the longitudinal direction of the rope. This kind of movement allows the sensing member to dodge away when pushed, thereby preventing rope from forcefully wedging between it and the rope wheel. This way rope damage can be avoided.

In a preferred embodiment, the sensing member is mounted pivotally displaceably by a rope colliding into contact with it around an axis parallel with the axial direction of the drive wheel, and the sensing arrangement is arranged to trigger said one or more predefined action in response to pivoting displacement of the sensing member. Thereby, said sensing member is displaceable at least in the longitudinal direction of the rope (having a component of movement in the longitudinal direction of the rope). This kind of movement allows the sensing member to dodge away when pushed, thereby preventing rope from forcefully wedging between it and the rope wheel. This way rope damage can be avoided. Preferably, the sensing member is mounted pivotally displaceably towards either turning direction around said axis. Thus, the sensing member can be engaged by the rope and be displaced pushed by the rope at least in the longitudinal direction of the rope independently of the movement direction of the rope.

In a preferred embodiment, the sensing arrangement comprises at least one electrical sensor arranged to sense position of the sensing member. The sensor may be arranged to sense directly position of the sensing member or a position of a component in fixed connection therewith.

Preferably, said belt-shaped ropes comprises a plurality of belt-shaped ropes, preferably three or more.

Preferably, said rope wheel is mounted to rotate at a stationary location, preferably at a stationary location above the elevator units. Preferably, said rope wheel is mounted on stationary structure(s) of the building, such as on structures of the hoistway or structures of a machine room provided close to, such as above or next to, the hoistway.

Preferably, the belt-shaped ropes interconnect a first elevator unit and the second elevator unit, the first unit being an elevator car and the second is a counterweight or a second elevator car.

Preferably, the elevator comprises a drive wheel engaging said ropes and a motor for rotating the drive wheel and an automatic elevator control for controlling the motor.

In a preferred embodiment, said rope wheel is a drive wheel for moving the ropes, and each circumferential rope contact area is a contact area for transmitting traction from rope wheel to the rope passing against it.

Preferably, each cambered circumferential rope contact area as well as the surface of the rope passing against it is smooth, in particular such that neither of said circumferential rope contact area nor the rope has protrusions extending into recesses of the other. The rope contact area is preferably cambered, whereby the control of axial position of each rope is provided by the shape of the cambered circumferential contact area against which the rope passes. Also, in case the rope wheel is a drive wheel, traction of each rope is based on frictional contact between the drive wheel and the rope instead of positive engagement.

Preferably, each rope passes around the rope wheel the wide side of the rope against a circumferential rope contact area of the wheel. There being several ropes, as illustrated, the ropes pass around the rope wheel adjacent each other in axial direction of the rope wheel as well as adjacent each other in the width-direction w of the ropes, the wide side of each rope against a circumferential rope contact area.

Preferably, the rope comprises one or more continuous load bearing members extending in longitudinal direction of the rope throughout the length of the rope. Thus, the rope is provided with good load bearing ability for the rope.

Preferably, said load bearing member(s) is/are made of composite material comprising reinforcing fibers embedded in polymer matrix. The reinforcing fibers are preferably carbon fibers, but also other fibers can be used, such as glass fibers. Preferably, the rope is such that reinforcing fibers are distributed in the matrix substantially evenly. Also preferably, all the individual reinforcing fibers of the load bearing member are bound to each other by the matrix.

Preferably, said load bearing member(s) is/are parallel with the longitudinal direction of the rope. Thereby, it/they provide excellent longitudinal stiffness for the rope. The reinforcing fibers are also preferably parallel with the longitudinal direction of the rope, which facilitates further the longitudinal stiffness of the rope.

Preferably, said load bearing member(s) is/are embedded in elastic coating forming the surface of the rope. Thus, the rope is provided with a surface via which the rope can effectively engage frictionally with a cambered contact area of the rope wheel, in terms of axial position control, as well as traction when the rope wheel is a drive wheel. With the coating, it is also possible to isolate load bearing members of each rope from each other in case there are several of them. The coating is particularly preferable in case where the load bearing member(s) is/are made of composite as defined, because thus the fragile and slippery load bearing member(s) are provided with protection as well as friction properties adjustable to perform well in terms of traction as well as axial position control.

The car is preferably arranged to serve two or more landings. The car preferably responds to calls from landing and/or destination commands from inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

DETAILED DESCRIPTION

Figure 1:
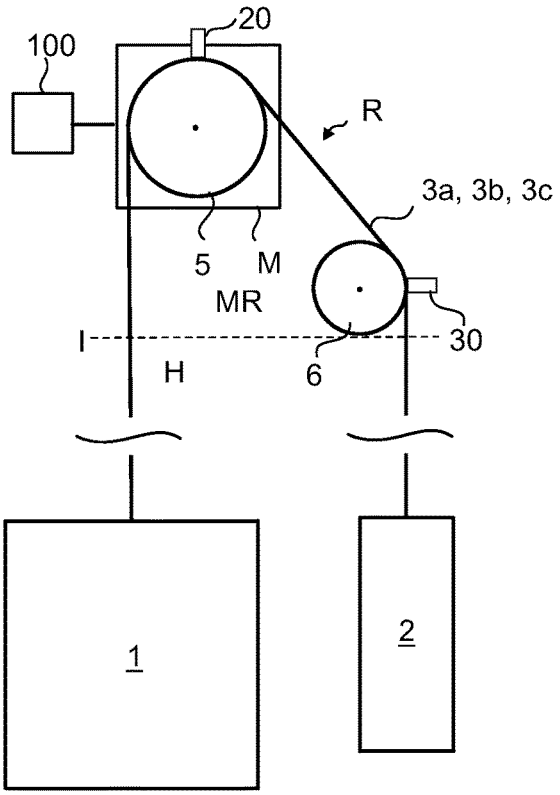
FIG. 1 illustrates schematically an elevator according to an embodiment of the invention as viewed from the side.

FIG. 1 illustrates an elevator according to a preferred embodiment of the invention. The elevator comprises a hoistway H and a first elevator unit 1 vertically movable in the hoistway H and a second elevator unit 2 vertically movable in the hoistway H. The first elevator unit 1 is in this embodiment an elevator car having an interior space suitable for receiving a passenger(s) and/or goods, the second elevator unit 2 being a counterweight.

The elevator further comprises a suspension roping R comprising several belt-shaped suspension ropes 3*a*,3*b*,3*c* connected to the car 1 and each having a width substantially larger than thickness as measured in transverse direction of the rope 3*a*,3*b*,3*c*. Each rope 3*a*,3*b*,3*c* interconnects the car 1 and the second elevator unit 2, which is in this case a counterweight, and passes around at least one rope wheel 5,6. In this case there are two rope wheels 5,6, which include a drive wheel 5 for moving said one or more belt-shaped suspension ropes 3*a*,3*b*,3*c* as well as a rope wheel 6, which is a non-driven rope wheel, i.e. a diverting wheel.

For providing force for moving the one or more suspension ropes 3*a*,3*b*,3*c*, and thereby also for the elevator units 1,2, the elevator comprises a power source, in particular a motor M, arranged to rotate the drive wheel 5 engaging the one or more suspension ropes 3*a*,3*b*,3*c*. The elevator further comprises an automatic elevator control 10 arranged to control the motor M, whereby rotation of the drive wheel and thereby also the movement of the car 1 is automatically controllable.

Figure 2A:
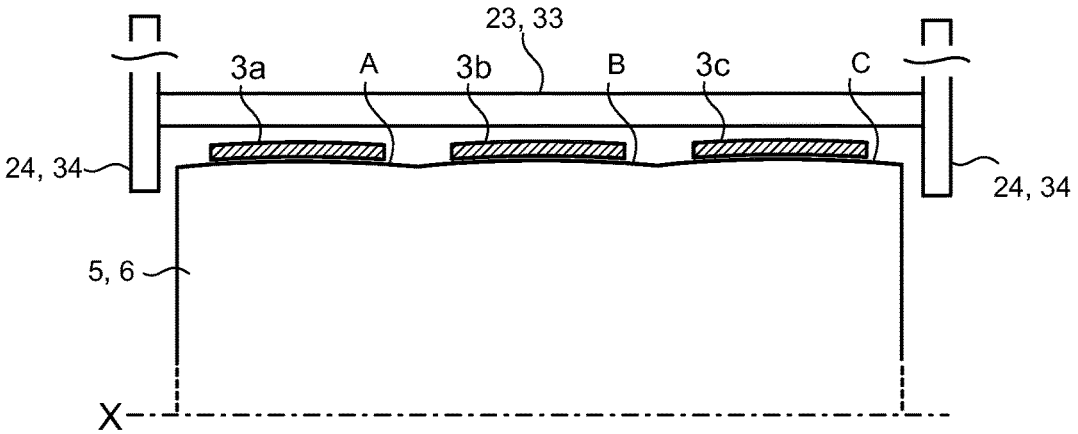
FIG. 2*a* illustrates schematically a cross sectional view of the ropes as they are positioned against a rope wheel of FIG. 1.

Passage of the ropes around said rope wheels 5,6 is illustrated in FIG. 2*a* showing a cross sectional view of the ropes as they are positioned against the rope wheels 5,6. Each said rope wheel 5, 6 comprises a plurality of circumferential rope contact areas A, B, C distributed side by side in axial direction thereof, and one of said ropes 3*a*,3*b*,3*c* is arranged to pass against each circumferential rope contact area A, B, C.

Figure 2B:
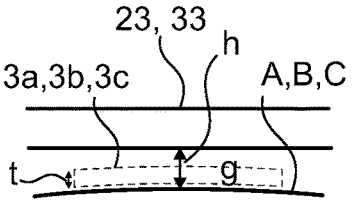
FIG. 2*b* illustrates in further detail a gap between a circumferential rope contact area of the rope wheel and the sensing member.
Figure 4:
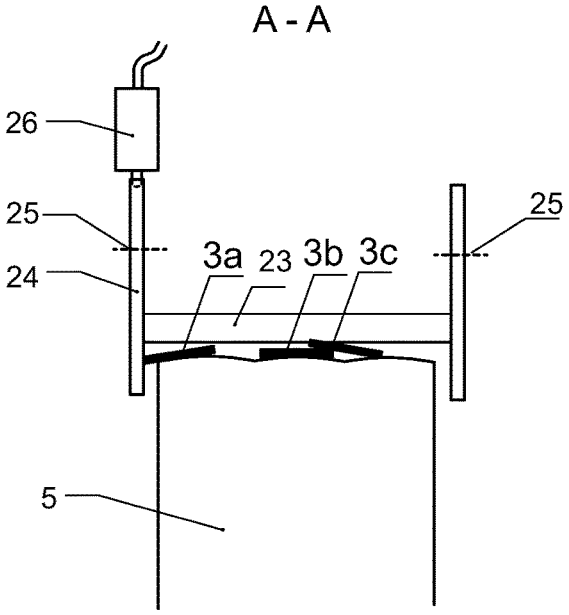
Figure 6:
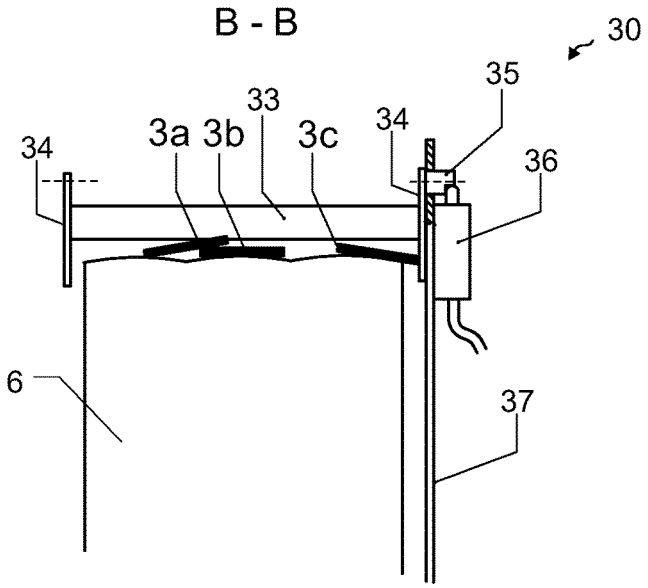

The elevator further comprises a sensing arrangement 20 for sensing displacement of one or more of said ropes 3*a*,3*b*,3*c* at the point of the rope wheel 5 and a sensing arrangement 30 for sensing displacement of one or more of said ropes 3*a*,3*b*,3*c* at the point of the rope wheel 6. Presence of such a sensing arrangement 20, 30 is however not necessary for both of the wheels 5,6 as it is clear that the elevator can be implemented also with only either one of them, depending of for which of rope wheels of the elevator rope position sensing needs to be provided. FIGS. 2*a* and 2*b* illustrated schematically details of the sensing arrangement 20, 30. The sensing arrangement 20, 30 comprises an elongated sensing member 23, 33 for sensing displacement of one or more of said ropes 3*a*,3*b*,3*c* radially outwards (upwards in FIG. 2*a*) from the rope wheel 5,6, which sensing member 23, 33 extends in axial direction of the rope wheel 5, 6 along its surface at a radial distance therefrom, whereby a gap g is formed between the sensing member 23, 33 and each rope contact area A, B, C, the height h of the gap g (as measured in radial direction of the rope wheel) being more than thickness t of the belt-shaped ropes 3*a*,3*b*,3*c* and less than 2.2 times the thickness of the belt-shaped ropes 3*a*,3*b*, 3*c*. Due to the height h of the gap g being adjusted as defined, the sensing member 23,33 is necessarily very close to the back surface of the ropes passing between the sensing member and the rope contact areas A, B, C. In case any of the ropes 3*a*,3*b*,3*c* happens to wander in axial direction of the rope wheel 5,6 away from its intended position, i.e. away from its rope 3*a*,3*b*,3*c* contact area A, B, C such that it crosses any of the other ropes 3*a*,3*b*,3*c*, a contact between the topmost of the crossing ropes and the sensing member 23,33 will likely to take place. This is because when an edge of a rope climbs on top of another rope at least a portion thereof is likely to extend from the surface of the circumferential rope contact area A,B,C against which the lowermost of the superposed ropes passes, up to such a radial distance, that it can at least momentarily reach into contact with the sensing member 23,33 positioned in the defined way. On the other hand the height h of the gap g being more than thickness t of the belt-shaped ropes 3*a*,3*b*,3*c* facilitates that no such contact takes place during normal situations where there is only said one rope resting firmly against each circumferential rope contact area A,B,C. The sensing member 23, 33 is arranged to be displaceable, in particular by a rope 3*a*,3*b*,3*c* colliding into contact with it, and the sensing arrangement 20, 30 is arranged to trigger one or more predefined action in response to displacement of the sensing member 23, 33. Thus, crossing of ropes can be detected and reacted to with one or more predefined action. Said one or more predefined action preferably includes at least stopping rotation of the drive wheel 5 of the elevator. A situation where the ropes cross each other such that there are two superposed ropes against the rope wheel 5,6 is illustrated in FIGS. 4 and 6.

So as to ensure a substantial running clearance between the ropes and the sensing member 23,33, it is preferable that the height h of the gap g is more than 1.5 times the thickness of the belt-shaped ropes 3*a*,3*b*,3*c*. Thus, unnecessary contacts between the rope 3*a*,3*b*,3*c* and the sensing member 23,33 during normal situations, as well as displacement of the sensing member 23,33 due to any small dirt drifting between rope 3*a*,3*b*,3*c* and the sensing member 23,33 can be reliably avoided. Also, in this way the sensing member 23,33 is more accurately focused on detecting situations where two of the ropes cross each other while at the rim of the rope wheel 5,6. As unnecessary displacement of the sensing member 23,33 are avoided, unnecessary elevator stops are avoided too. To ensure that said contact occurs in any possible kind of crossing of two of the ropes, it is preferable that the height h is as small as equal to or even less than 2 times the thickness of the belt-shaped ropes.

The ropes being belt-shaped they have two oppositely facing wide sides extending in width direction of the rope (which face in FIGS. 2*a*, 4 and 6 upwards and downwards), as well as lateral flanks (which face in said Figures left and right). Each rope 3*a*,3*b*,3*c* passes around the rope wheel 5,6 the wide side of the rope 3*a*,3*b*,3*c* against the rope wheel 5,6 in question. There being several ropes 3*a*,3*b*,3*c*, as illustrated, the ropes 3*a*,3*b*,3*c* pass around each of said rope wheels 5,6 adjacent each other in axial direction X of the wheel 5,6 as well as adjacent each other in the width-direction w of the ropes, the wide sides of each rope 3*a*,3*b*,3*c* against the wheel in question.

The rope wheels 5,6 are in the embodiments illustrated cambered, particularly each of said rope contact areas A,B,C is cambered. Thus, each rope wheel 5,6 comprises a cambered circumferential rope contact area A,B,C for each of said one or more ropes 3*a*,3*b*,3*c* against which circumferential surface area A,B,C the rope in question is arranged to pass. In this way the axial position, i.e. the position of each of said belt-shaped ropes 3*a*,3*b*,3*c* in axial direction X of the wheel 5,6 around which is passes, is controlled. In these embodiments, each cambered circumferential surface area A,B,C has a convex shape against the peak of which the rope passes. The cambered shape tends to keep the rope passing around it positioned resting against the peak thereof, thereby resisting displacement of the rope 3*a*,3*b*,3*c* away from this position in said axial direction X. The rope contact areas A,B,C being cambered, said height h is the radial (referring to radius of the rope wheel in question) distance between the peak of the cambered circumferential rope contact area A,B,C and the sensing member 23,33, in particular the side face thereof facing the rope wheel 5,6 in question.

Said sensing member 23,33 is preferably elongated and oriented in axial direction of the rope wheel 5, 6. Preferably, it is in the form of an elongated bar, such as an elongated tube or a solid bar. Said sensing member 23,33 can be made for example of metal or metal and elastomer. In the latter case it has a metallic body coated with elastomer, whereby the contact with the ropes can be made gentler.

The immediately adjacent ropes 3*a*,3*b*;3*b*,3*c* passing against a circumferential rope contact area have a space between them in axial direction of the rope wheel 5,6. It is particularly preferable that the spaces between immediately adjacent ropes 3*a*,3*b*;3*b*,3*c* passing against a circumferential rope contact area are completely devoid of components of the sensing member 23,33 (or any component attached thereto). This is advantageous, because this makes it possible that each rope can wander and seek its position on the cambered area without triggering any safety measures. This kind of position seeking can happen because of building sway, loading or unloading of machinery room floor, for instance. For this end, it is preferable that said sensing member 23,33 does not have protrusions extending therefrom towards the drive wheel into spaces between immediately adjacent ropes 3*a*,3*b*;3*b*,3*c* passing against a circumferential rope contact area. It is even preferable, that the spaces between immediately adjacent ropes 3*a*,3*b*;3*b*,3*c* passing against a circumferential rope contact area are completely devoid of any other components surrounding the rope wheel 5,6. In the preferred embodiment, the elongated sensing member comprises an elongated and at least substantially straight side face facing the drive wheel and extending over all the rope contact areas. For this end, the sensing member is preferably a straight bar.

In addition to the aforementioned sensing of displacement of one or more of said ropes 3*a*,3*b*,3*c* radially outwards from the rope wheel, it is preferable that also displacement of one or more of said ropes axially outwards from the rope wheel is sensed. Thus, it can be detected whether the outermost (in axial direction) of the ropes is about to move around the edge of the rope wheel 5,6 and fall away from the rim thereof. Ropes 3*a*,3*b*,3*c* can be displaced in this direction without crossing each other, for example when they all move simultaneously, whereby progress of a faulty situation would not necessarily be detected with mere sensing of rope crossing. By sensing displacement also in this direction, the ropes are given limits in the most meaningful directions and in a way that is simple yet efficient to sense rope crossing and rope displacement axially dangerously far towards the edge of the rope wheel. For this purpose, the sensing arrangement further comprises a second sensing member 24,34 for sensing displacement of one or more of said ropes 3*a*,3*b*,3*c* axially outwards from the rope wheel 5,6 on axially outer side of each axially outermost rope 3*a*, 3*c* the second sensing member 24,34 being displaceable by a rope 3*a*,3*b*,3*c* colliding into contact with it, and the sensing arrangement is arranged to trigger said one or more predefined action in response to displacement of the structure formed by the sensing member 24,34. It is preferable, that each second sensing member 24,34 is fixedly connected to aforementioned sensing member whereby they are displaceable together with similar movement as one structure by a rope colliding into contact with any one of them, and the sensing arrangement is arranged to trigger said one or more predefined action in response to displacement of the structure formed by said sensing members (23 and 24; 33 and 34).

Preferably, the circumferential surface area A,B,C as well as the surface of the rope via which the rope 3*a*,3*b*,3*c* rest against the circumferential rope contact area A,B,C in question are both smooth such that neither of said circumferential surface area A,B,C nor the rope 3*a*,3*b*,3*c* has protrusions extending into recesses of the other. In this case, said circumferential rope contact area nor the rope surface are not configured for engaging to each other via a polyvee- or toothed engagement. Smoothness also facilitates efficiency of the rope position control by the cambered shape of the rope wheel.

As illustrated in FIG. 1, it is preferable that said rope wheels 5,6 are mounted to rotate at a stationary location above the elevator units 1, 2. It is preferable, that the elevator is installed in a building. Then, preferably said at least one rope wheel 5,6 is mounted on stationary structure(s) of the building, such as on structures of the hoistway H or structures of a machine room MR provided close to, such as above or next to the hoistway H. In FIG. 1, the machine room MR is above the common hoistway H, where the elevator units 1 and 2 travel. Dashed line I represents the floor line of the machine room MR. It is of course obvious, that the elevator could alternatively be implemented without a machine room and/or such that the elevator units travel in different hoistways.

Figure 3:
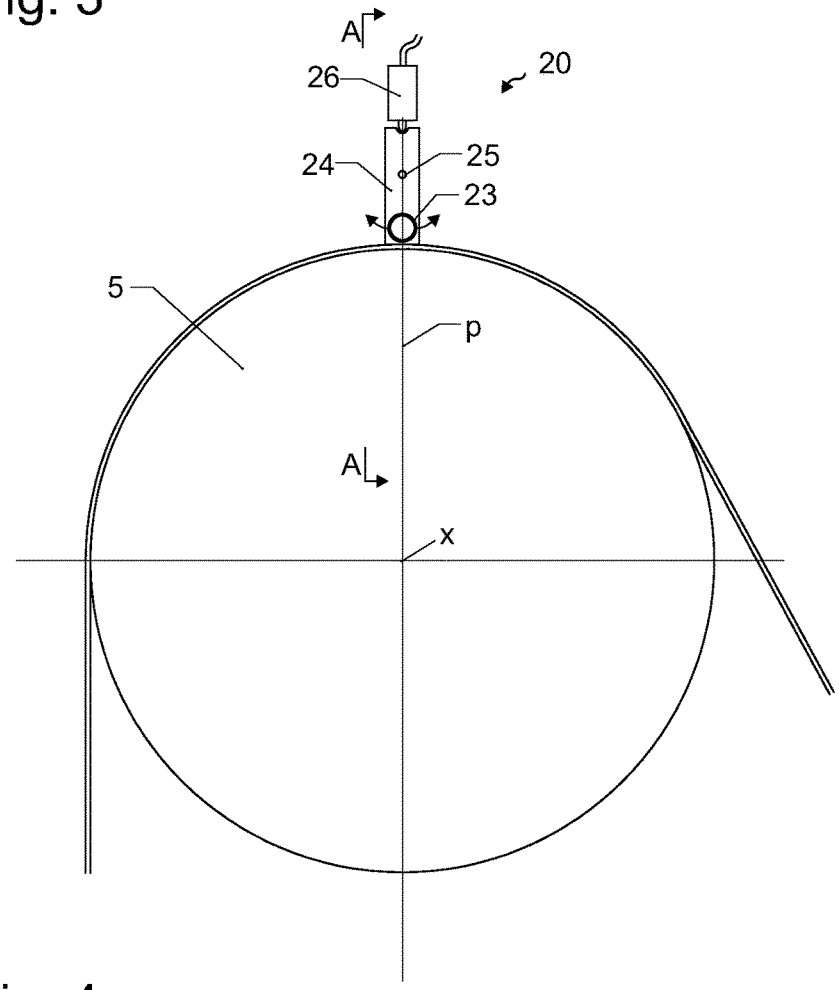
FIGS. 3 and 4 preferred further details for the sensing arrangement of FIG. 1 according to a first embodiment.

FIGS. 3 and 4 illustrate preferred further details for the sensing arrangement 20. FIG. 4 illustrates the ropes in a faulty situation wherein ropes 3*b* and 3*c* have crossed each other and are partially superposed, and wherein rope 3*a* has moved partially beyond the axial edge of the rope wheel 5.

The sensing member 23 is mounted pivotally, such that it can pivot around an axis 25, which is parallel with the axial direction of the drive wheel 5. Thereby, the sensing member 23 is pivotally displaceable by a rope colliding into contact with it around the axis 25. In case two of the ropes 3*a*,3*b*,3*c* cross, the overall height of the superposed ropes is such that the topmost rope contacts the sensing member 23 and wedges the sensing member 23 and the rope wheel 5. The sensing arrangement 20 is arranged to trigger said one or more predefined action in response to displacement of the sensing member 23, which displacement is in this case particularly pivoting displacement.

The sensing member 23 being mounted pivotally in the defined way gives it the movability such that it is displaceable in the longitudinal direction of the rope 3*a*,3*b*,3*c*. The rope 3*a*,3*b*,3*c*, when it moves in its longitudinal direction during elevator use and is displaced in said radial direction to collide into contact with the sensing member 23 is arranged to engage the sensing member 23 and push and displace it in the longitudinal direction of the rope 3*a*,3*b*,3*c* thereby causing said pivoting displacement in response to which the sensing arrangement 30 triggers said one or more predefined action. This kind of movement allows the sensing member 23 to dodge away when pushed, thereby preventing rope wedging between it and the rope wheel 5. This way rope damage can be avoided.

In accordance with what is described referring to FIG. 2, in this embodiment, the sensing arrangement 20 further comprises a second sensing member 24 for sensing displacement of one or more of said ropes 3*a*,3*b*,3*c* axially outwards from the rope wheel 5 on axially outer side of each axially outermost rope 3*a*, 3*c*. Each said second sensing member 24,34 is displaceable by a rope 3*a*,3*b*,3*c* colliding into contact with it, and the sensing arrangement 20 is arranged to trigger said one or more predefined action also in response to displacement of the second sensing member 24. The second sensing member 24 is displaceable by a rope 3*a*,3*b*, 3*c* colliding into contact with it in the same manner as the aforementioned sensing member 23, i.e. pivotally around an axis 25 parallel with the axial direction of the rope wheel 5, and the sensing arrangement 20 is arranged to trigger said one or more predefined action in response to pivoting displacement of the sensing member 23. Thus, also the second sensing member 24 is displaceable in the longitudinal direction of the rope 3*a*,3*b*,3*c*. Hereby, the rope 3*a*,3*b*,3*c* is arranged, when it moves in its longitudinal direction during elevator use and is displaced in said axial direction to collide into contact with the second sensing member 24, to engage the sensing member 24 and push and displace it in the longitudinal direction of the rope 3*a*,3*b*,3*c* thereby causing said pivoting displacement in response to which the sensing arrangement 20 triggers said one or more predefined action. This kind of movement allows the second sensing member 24 to dodge away when pushed, thereby preventing rope wedging between it and the rope wheel 5. This way, rope damage can be simply avoided.

In the case shown in FIGS. 3 and 4, each said second sensing member 24 is fixedly connected to the aforementioned sensing member 23 whereby the sensing members 23 and 24 are displaceable together as one structure by a rope colliding into contact with any one of them. In this case, the sensing arrangement 20 is arranged to trigger said one or more predefined action in response to displacement of the structure formed by said sensing members 23 and 24.

The sensing arrangement 20 comprises an electrical sensor 26 arranged to sense position of the sensing members 23 and 24. Said sensing members 23,24 being in this embodiment displaceable together as one structure, direct sensing of displacement of only one of them is needed in this case. Should they be mounted separately, displacement of each of them would need to be sensed separately, e.g. with separate electrical sensors. In the embodiment illustrated, the electrical sensor 26 is arranged to sense position of the sensing member 23 via the second sensing member 24.

Figure 9:
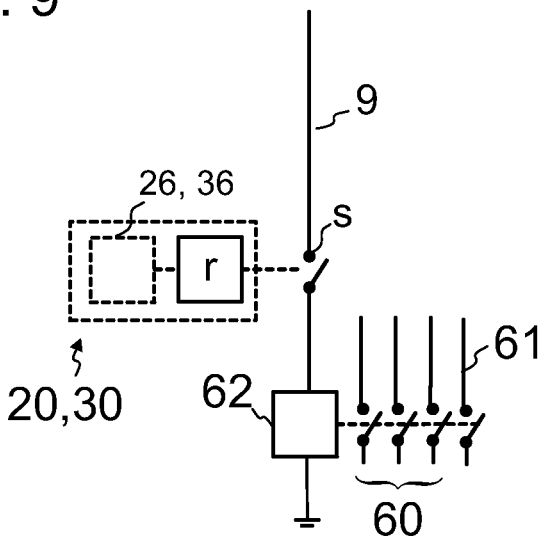
FIG. 9 preferred further details of elevator of FIG. 1.

Said electrical sensor 26 is preferably connected to a relay r operating a safety switch s of the safety circuit 9, as illustrated in FIG. 9, whereby said displacement can trigger cutting of the safety circuit and thereby said one or more predefined action. The triggering could alternatively be carried out in some other way. For example, the electrical sensor 26 could be connected to the automatic elevator control 10 arranged carry out the one or more predefined action triggered by the electrical sensor 26 of the sensing arrangement 20 in response to displacement of the sensing member 23.

Figure 5:
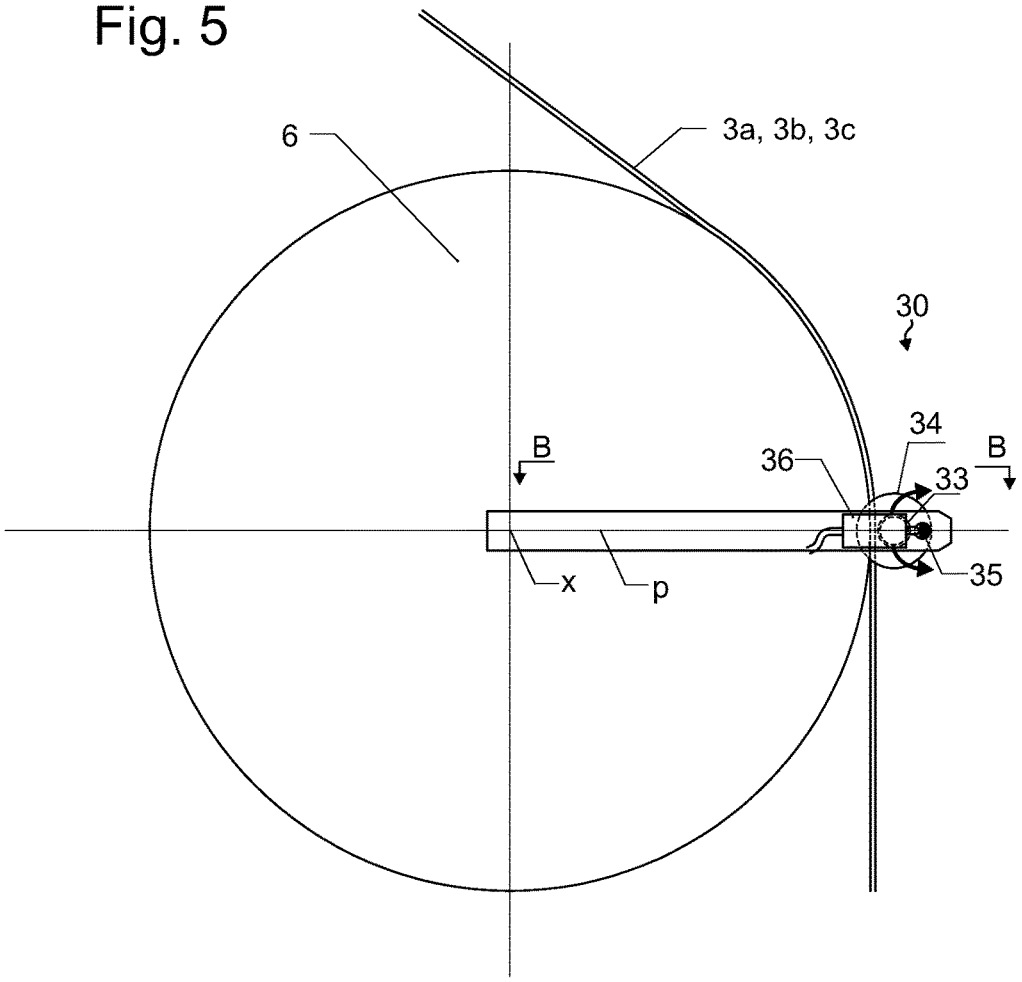
FIGS. 5 and 6 preferred further details for the sensing arrangement of FIG. 1 according to a second embodiment.

FIGS. 5 and 6 illustrate preferred further details for the sensing arrangement 30. FIG. 6 illustrates the ropes in a faulty situation wherein ropes 3*b* and 3*c* have crossed each other and are partially superposed, and wherein rope 3*a* has moved partially beyond the axial edge of the rope wheel 6.

The sensing member 33 is mounted pivotally, such that it can pivot around an axis 35, which is parallel with the axial direction of the drive wheel 6. Thereby, the sensing member 33 is pivotally displaceable by a rope colliding into contact with it around the axis 35. In case ropes cross, the overall height of the superposed ropes is such that the topmost rope contacts the sensing member 33 and wedges between the sensing member 33 and the rope wheel. The sensing arrangement 30 is arranged to trigger said one or more predefined action in response to displacement of the sensing member 33, which displacement is in this case particularly pivoting displacement.

The sensing member 33 being mounted pivotally in the defined way gives it the movability such that it is displaceable in the longitudinal direction of the rope 3*a*,3*b*,3*c*. The rope 3*a*,3*b*,3*c*, when it moves in its longitudinal direction during elevator use and is displaced in said radial direction to collide into contact with the sensing member 33 is arranged to engage the sensing member 33 and push and displace it in the longitudinal direction of the rope 3*a*,3*b*,3*c* thereby causing said pivoting displacement in response to which the sensing arrangement 30 triggers said one or more predefined action. This kind of movement allows the sensing member 33 to dodge away when pushed, thereby preventing rope wedging between it and the rope wheel 6. This way rope damage can be avoided.

In accordance with what is described referring to FIG. 2, in this embodiment, the sensing arrangement 30 further comprises a second sensing member 34 for sensing displacement of one or more of said ropes 3*a*,3*b*,3*c* axially outwards from the rope wheel 6 on axially outer side of each axially outermost rope 3*a*, 3*c*. Each said second sensing member 34 is displaceable by a rope 3*a*,3*b*,3*c* colliding into contact with it, and the sensing arrangement 30 is arranged to trigger said one or more predefined action also in response to displacement of the second sensing member 34. The second sensing member 34 is displaceable by a rope 3*a*,3*b*,3*c* colliding into contact with it in the same manner as the aforementioned sensing member 33, i.e. pivotally around an axis 35 parallel with the axial direction of the rope wheel 6, and the sensing arrangement 30 is arranged to trigger said one or more predefined action in response to pivoting displacement of the sensing member 33. Thus, also the second sensing member 34 is displaceable in the longitudinal direction of the rope 3*a*,3*b*,3*c*. Hereby, the rope 3*a*,3*b*,3*c*, when it moves in its longitudinal direction during elevator use and is displaced in said axial direction to collide into contact with the second sensing member 34 is arranged to engage the sensing member 24 and push and displace it in the longitudinal direction of the rope 3*a*,3*b*,3*c* thereby causing said pivoting displacement in response to which the sensing arrangement 30 triggers said one or more predefined action. This kind of movement allows the second sensing member 34 to dodge away when pushed, thereby preventing rope wedging between it and the rope wheel 6. This way rope damage can be avoided.

In this case, each said second sensing member 34 is fixedly connected to the aforementioned sensing member 33 whereby the sensing members 33 and 34 are displaceable together as one structure by a rope colliding into contact with any one of them. In this case, the sensing arrangement 30 is arranged to trigger said one or more predefined action in response to displacement of the structure formed by said sensing members 33 and 34.

The sensing arrangement 30 comprises an electrical sensor 36 arranged to sense position of the sensing members 33 and 34. Said sensing members 33,34 being in this embodiment displaceable together as one structure, sensing of displacement of only one of them is needed in this case. Should they be mounted separately, displacement of each of them would need to be sensed separately, e.g. with separate electrical sensors. In the embodiment illustrated, the electrical sensor 36 is arranged to sense position of the sensing member 33 via the second sensing member 34.

Said electrical sensor 36 is preferably connected to a relay r operating a safety switch s of the safety circuit 9, as illustrated in FIG. 9, whereby said displacement can trigger cutting of the safety circuit and thereby said one or more predefined action. The triggering could alternatively be carried out in some other way. For example, the electrical sensor 36 could be connected to the automatic elevator control 10 arranged carry out the one or more predefined action triggered by the electrical sensor 36 of the sensing arrangement 30 in response to displacement of the sensing member 33. In FIG. 6, the arrangement 30 is mounted on a stationary structure 37.

In either of the embodiments of FIGS. 3 to 6, the sensing member 23 is mounted pivotally displaceably towards either turning direction around said axis 25,35. Thus, the sensing member can be engaged by the rope 3*a*,3*b*,3*c* and be displaced pushed by the rope at least in the longitudinal direction of the rope 3*a*,3*b*,3*c* independently of the movement direction of the rope. For this end, it is preferable that said axis 25,35 as well as said sensing member 23,33 are both positioned on a radial plane p along which the axis x of the rope wheel 5,6 passes. Thus, the sensing member is pivotally displaceable towards either turning direction without problems. For enhancing the dodging, it is preferable that the sensing member 23,33 is mounted pivotally such that it can pivot around an axis 25,35, which is parallel with the axial direction of the rope wheel 5,6 and further away in radial direction of the rope wheel 5,6 from the circumferential rope contact areas A,B,C than the back side face of the sensing member 23,33 (i.e. the side face facing away from the circumferential rope contact areas A,B,C) at the point of the circumferential rope contact areas A,B,C. Thus, when pushed by one of the ropes the sensing member 23 effectively dodges away from rope contact by pivoting steeply away from the rope wheel 5,6.

It is preferable, that each of said one or more ropes 3*a*,3*b*,3*c* comprises one or more continuous load bearing members 40, which load bearing members 40 extending in longitudinal direction of the rope 3*a*,3*b*,3*c* throughout the length of the rope 3*a*,3*b*,3*c*, which load bearing member(s) 40 is/are made of composite material comprising reinforcing fibers f embedded in polymer matrix m. Said fibers f are preferably carbon fibers. Preferably, the one or more continuous load bearing members 40 is/are embedded in elastic coating forming the surface of the rope. Thus, the rope is provided with a surface via which the rope can effectively and without damage engage with both the rope wheel 5,6 and the sensing member 23,33. Thus, it can also engage rope wheel (when the rope wheel is cambered) efficiently in terms of axial position control as well as traction in case the rope wheel is a drive wheel. Further preferred details of the rope 3*a*,3*b*,3*c* will be later described in context of description of FIG. 7.

Figure 7:
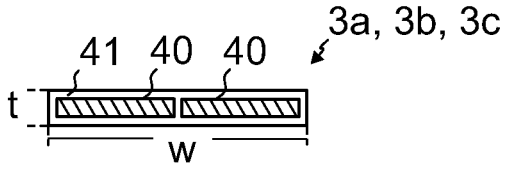
FIG. 7 illustrates the cross section of a preferred structure for an individual rope.

FIG. 7 illustrates a cross section of a preferred structure for an individual rope 3*a*,3*b*,3*c*. The rope 3*a*,3*b*,3*c* is in the form of a belt, and thereby has a width w substantially larger than the thickness t thereof. This makes it well suitable for elevator use as small radius bending of the rope 3*a*,3*b*,3*c* is necessary in most elevators. The rope 3*a*,3*b*,3*c* comprises continuous load bearing members 40 extending in longitudinal direction of the rope 3*a*,3*b*,3*c* throughout the length of the rope 3*a*,3*b*,3*c*. The number of load bearing members 40 comprised in the rope 3*a*,3*b*,3*c* can alternatively be also greater or smaller than the two shown in FIG. 7. Each of the load bearing member(s) 40 is parallel with the longitudinal direction of the rope 3*a*,3*b*,3*c*, whereby excellent longitudinal stiffness for the rope 3*a*,3*b*,3*c* is provided. The fibers f preferably are continuous fibers, in particular fibers continuous throughout the length of the rope 3*a*,3*b*,3*c*. So as to provide the rope 3*a*,3*b*,3*c* with a turning radius well suitable for elevator use, it is preferable that the width/thickness ratio of the rope is substantial, in particular more than 2, preferably more than 4 as illustrated. Thus, reasonable bending radius can be achieved for the rope 3*a*,3*b*,3*c* even when it contains substantially material of high bending rigidity, such as fiber reinforced composite material.

The load bearing members 40 are preferably embedded in an elastic coating 41 forming the surface of the rope 3*a*,3*b*, 3*c*, as illustrated. The coating 41 is preferably made of elastomer. In general, the elastic coating 41 provides the rope 3*a*,3*b*,3*c* good wear resistance, protection, and isolates the load bearing members 40 from each other. The elastic coating 41 also provides the rope high friction, for instance for frictional traction contact with a drive wheel 5 as illustrated in FIG. 1. The elastomer is preferably polyurethane, which provides best results in terms of traction and durability in elevator use.

Figure 8:
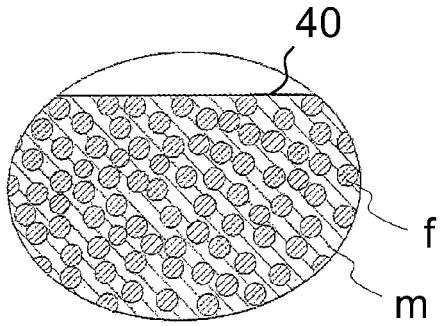
FIG. 8 illustrates inside the circle a partial and enlarged cross-section of the load bearing member of FIG. 7.

Preferably, each of said load bearing members 40 is made of composite material comprising reinforcing fibers f embedded in polymer matrix m. FIG. 8 illustrates inside the circle a partial and enlarged cross-section of the load bearing member 40 of the rope 3*a*,3*b*,3*c*. The material provides the rope 3*a*,3*b*,3*c* excellent longitudinal stiffness and low weight, which are among preferred properties for an elevator. The reinforcing fibers f are most preferably carbon fibers, which are most advantageous in terms of longitudinal stiffness as well as weight.

To reduce buckling of fibers and to facilitate a small bending radius of the rope, among other things, it is therefore preferred that the polymer matrix is hard, and in particular non-elastomeric. The most preferred materials are epoxy resin, polyester, phenolic plastic or vinyl ester. The matrix of the load bearing member 40 is preferably such that the module of elasticity E of the polymer matrix is over 2 GPa, most preferably over 2.5 GPa, yet more preferably in the range 2.5-10 GPa, most preferably of all in the range 2.5-3.5 GPa. The structure is advantageous as hereby the service life of the rope can be extended.

The composite material is preferably such that the individual reinforcing fibers are parallel with the length direction of the rope. Thus, they provide excellent longitudinal stiffness for the rope. The individual reinforcing fibers are preferably distributed in the matrix substantially evenly, such that substantially all the individual reinforcing fibers of the load bearing member are bound to each other by the matrix. The rope 3*a*,3*b*,3*c* is preferably in accordance with any one of the composite ropes disclosed in international patent application WO2009090299A1.

As mentioned, said one or more predefined action includes stopping rotation of the drive wheel of the elevator. It is preferable that said stopping rotation of the drive wheel includes braking rotation of the drive wheel 5 with mechanical brake(s) of the elevator acting on the drive wheel or a component fixed thereto and/or stopping the motor M from rotating the drive wheel 5. Thus, the faulty situation can be reacted to swiftly and efficiently in terms of safety and simplicity. FIG. 9 shows an arrangement wherein said triggering includes breaking of the safety circuit 9 of the elevator breaking of which is arranged to cause activation of mechanical brake(s) of the elevator and/or stopping of the motor 7 from rotating the drive wheel 6. It is preferable, that the breaking of the safety circuit 9 causes that power supply 60 to the frequency converter of the motor M is cut and/or that the power supply 61 of the actuator(s) of the brake(s) b is cut, which actuator(s) keep(s) the brake(s) b normally in released state when powered. As illustrated, the safety circuit 9 is a circuit connected to a contactor 62, which may be in the form of a relay, controlling switches of the power supply lines 60 and 61. The safety circuit 9 is under voltage and the breaking thereof is arranged to cause the contactor 62 to release said switches to opened state and thereby to break the power supply of these power lines 60,61. For the purpose of breaking the safety circuit 9 in context of said triggering, said arrangement 20,30 preferably comprise a means, such as a relay r, operating a safety switch s of the safety circuit 9. The relay r is preferably a normally closed-type relay (NC), for instance relay in the form of a SPSTNC-type relay.

As mentioned, one of said rope wheels 5 is preferably a drive wheel for moving the ropes. In this case, each circumferential rope contact area A,B,C of the drive wheel 5 is a contact area for transmitting traction from rope wheel 5 to the rope passing against it.

In the preferred embodiment described above, the two elevator units 1,2 form a balancing weight for each other by affecting each other via said one or more ropes whereby they are economical to move. The inventive concept can however be implemented alternatively in counterweightless elevators.

In the preferred embodiment described above, the rope wheel 5,6 at the point of which the rope position is sensed, are cambered. Although preferable, this is not necessary the by providing a sensing arrangement as illustrated, position of rope could be sensed reliably also when the rope wheel has a non-cambered rope contact areas, such as in case the rope wheel has a flat circumferential rope contact area for each rope. This would be realized for example if the rope wheel is in the form of a regular cylinder.

When the rope wheel is cambered, it is preferably, however not necessarily formed such that between immediately adjacent rope contact areas, there is a depression formed by flanks of the peak of adjacent rope contact areas, as illustrated in Figures of this application. Thereby, the cambered shape is simple to manufacture. Benefits of the invention are most clearly present in this context, because there are no flanges between the adjacent peaks resisting axial movement of the ropes.

The sensing member 23,33 is as mentioned preferably mounted pivotally. More specifically, the sensing member 23,33 is preferably mounted pivotally free to rotate an angle substantially less than a full revolution (360 deg), preferably an angle which is in the range 10-270 deg, preferably in the range 30-200 deg. Thus, the angle is simply within range ensuring easy sensing, however safe pivoting. Particularly, the moving rope colliding into contact with the sensing member cannot put it into rotation, which would be likely to cause harm to the rope as well as the sensing arrangement.

The arrangement 20,30 is preferably mounted at a suitable location near the rope wheel 5,6, preferably on a stationary structure of the elevator.

It is to be understood that the above description and the accompanying Figures are only intended to illustrate the present invention. It will be apparent to a person skilled in the art that the inventive concept can be implemented in various ways. For example, the belt-shaped rope can have an internal structure or surface different from what has been presented as preferred. Also, the position of ropes can be sensed in the disclosed fashion regardless of how many rope wheels the elevator has. Furthermore, even though it is preferable, it is not necessary that the sensing member(s) are mounted pivotally. The sensing member(s) could alternatively be mounted displaceably, with linear motion for instance. The invention and its embodiments are not limited to the examples described above but may vary within the scope of the claims.

The invention claimed is:

1. An elevator comprising:

an elevator car;

at least one rope wheel including circumferential rope contact areas distributed in an axial direction of the at least one rope wheel;

belt-shaped ropes connected to the elevator car, the belt-shaped ropes configured to pass over the at least one rope wheel such that each of the belt-shaped ropes passes against a respective one of the circumferential rope contact areas, the belt-shaped ropes each having a width larger than a thickness as measured in a transverse direction of the belt-shaped ropes; and a sensing arrangement configured to sense displacement of one or more of the belt-shaped ropes on the at least one rope wheel, the sensing arrangement including, a first sensing member configured to sense displacement of one or more of the belt-shaped ropes radially outwards from the at least one rope wheel, the first sensing member extending in the axial direction of the at least one rope wheel along a surface of the at least one rope wheel at a radial distance therefrom such that, when the belt-shaped ropes are not displaced, the first sensing member does not protrude between any portion of any two belt-shaped ropes among the belt-shaped ropes and the first sensing member extends along the surface of the at least one rope wheel at a radial distance therefrom with a gap between the first sensing member and each of the circumferential rope contact areas, a height of the gap being more than the thickness of the belt-shaped ropes and less than 2.2 times the thickness of the belt-shaped ropes, the first sensing member being displaceable by one of the belt-shaped ropes colliding into contact with the first sensing member, and the sensing arrangement being arranged to trigger one or more actions in response to displacement of one of the sensing members, and a second sensing member on an axially outer side of axially outermost one of the belt-shaped ropes, the second sensing member configured to sense displacement of one or more of the belt-shaped ropes axially outwards from the at least one rope wheel, the second sensing member being displaceable by one of the belt-shaped ropes colliding into contact with the second sensing member, the sensing arrangement being configured to trigger the one or more actions in response to displacement of the second sensing member, the second sensing member not protruding between any portion of any two belt-shaped ropes among the belt-shaped ropes when the belt-shaped ropes are not displaced.

2. The elevator according to claim 1, wherein the second sensing member is connected to the first sensing member to sense displacement of one or more of the belt-shaped ropes radially outwards from the at least one rope wheel, the first sensing member and the second sensing member being displaceable together as one structure and the sensing arrangement being configured to trigger the one or more action in response to displacement of the first sensing member and the second sensing member.

3. The elevator according to claim 1, wherein the at least one rope wheel is a drive wheel configured to move the belt-shaped ropes, and each of the circumferential rope contact areas is a contact area for transmitting traction from the at least one rope wheel to one of the belt-shaped ropes passing against the at least one rope wheel.

4. The elevator according to claim 3, wherein each of the circumferential contact areas is cambered.

5. The elevator according to claim 4, wherein each of the circumferential contact areas and a surface of each of the belt-shaped ropes resting against the circumferential contact areas are smooth.

6. The elevator according to claim 3, wherein the one or more actions include stopping a rotation of the drive wheel of the elevator.

7. The elevator according to claim 3, wherein the elevator further comprises:

a motor configured to rotate the drive wheel, wherein the elevator is configured to control the motor.

8. The elevator according to claim 1, wherein the height of the gap is more than 1.5 times the thickness of the belt-shaped ropes.

9. The elevator according to claim 1, wherein the height of the gap is equal or less than 2 times the thickness of the belt-shaped ropes.

10. The elevator according to claim 1, wherein the first sensing member is displaceable at least in a longitudinal direction of the belt-shaped ropes such that, when the belt-shaped ropes move in the longitudinal direction during elevator use and are displaced in a radial direction to collide into contact with the first sensing member, the first sensing member is configured to displace at least in the longitudinal direction of the belt-shaped ropes.

11. The elevator according to claim 1, wherein the first sensing member is mounted pivotally displaceably around an axis parallel with the axial direction of the at least one rope wheel, and the sensing arrangement is configured to trigger the one or more actions in response to a pivoting displacement of the first sensing member.

12. The elevator according to claim 1, wherein each of the belt-shaped ropes comprises:

one or more continuous load bearing members the load bearing members being made of a composite material including reinforcing fibers embedded in a polymer matrix.

13. The elevator according to claim 1, wherein each of the belt-shaped ropes comprises:

one or more continuous load bearing members, the load bearing members being embedded in an elastic coating forming a surface of one of the belt-shaped ropes.

14. A sensor arrangement comprising:

one or more sensors associated with at least one rope wheel, the one or more sensors including, a first sensor configured to sense displacement of belt-shaped ropes radially outward from the at least one rope wheel, the first sensor having a bottom side spaced apart from the at least one rope wheel such that, when the belt-shaped ropes are not displaced, the first sensor does not protrude between any portion of any two belt-shaped ropes among the belt-shaped ropes and the bottom side is spaced apart from the at least one rope wheel with a gap between the bottom side and the at least one rope wheel, a size of the gap being greater than a thickness of the belt-shaped ropes, and a second sensor configured to sense displacement of belt shaped ropes axially outward from the at least one rope wheel such that, when the belt shaped ropes are not displaced, the second sensor does not protrude between any portion of any two belt-shaped ropes among the belt shaped ropes.

15. The sensor arrangement of claim 14, wherein the size of the gap is less than twice the thickness of the one of the belt-shaped ropes and more than 1.5 times the thickness of the one of the belt-shaped ropes.

16. The sensor arrangement of claim 14, wherein the at least one rope wheel further comprises:

circumferential rope contact areas such that one of the belt-shaped ropes passes against each of the circumferential rope contact areas.

17. The sensor arrangement of claim 16, wherein the second sensor is connected to the first sensor such that the first and second sensors form one body, and the second sensor extends radially inward from the first sensor.

18. The sensor arrangement of claim 14, wherein one of the al least one rope wheel is a drive wheel configured to move the belt-shaped ropes.

19. The sensor arrangement of claim 14, wherein the sensors are arranged such that a space between a first one of the belt-shaped ropes immediately adjacent to a second one of the belt-shaped ropes is devoid of components of the first sensor.

* * * * *